US007887343B2

(12) United States Patent
Ryan

(10) Patent No.: US 7,887,343 B2
(45) Date of Patent: Feb. 15, 2011

(54) CONTROL APPARATUS FOR ELECTRICAL DEVICES

(76) Inventor: Charles Jeffrey Ryan, 3175 Twilight Ct., Middleburg, FL (US) 32068

( * ) Notice: Subject to any disclaimer, the term of this patent is extended or adjusted under 35 U.S.C. 154(b) by 0 days.

(21) Appl. No.: 12/484,275

(22) Filed: Jun. 15, 2009

(65) Prior Publication Data

US 2010/0317204 A1 Dec. 16, 2010

(51) Int. Cl.
*H01R 13/44* (2006.01)

(52) U.S. Cl. ..... 439/133; 439/144; 307/141

(58) Field of Classification Search ..... 439/133, 439/142, 141, 144; 307/141; 174/67; 361/643; 200/43.02, 43.22
See application file for complete search history.

(56) References Cited

U.S. PATENT DOCUMENTS 3,345,603 A 10/1967 Cohen
4,063,110 A * 12/1977 Glick ..... 307/112
4,479,688 A 10/1984 Jennings
4,482,789 A 11/1984 McVey
4,647,735 A 3/1987 Sicher
5,071,360 A 12/1991 Lindow et al.
5,283,475 A * 2/1994 Berger ..... 307/141.4
6,519,208 B2 * 2/2003 DeVries ..... 368/10
7,025,627 B2 * 4/2006 Rosenthal et al. ..... 439/501
2006/0137962 A1 6/2006 Schluter et al.
2006/0283693 A1 12/2006 Schluter et al.

* cited by examiner

*Primary Examiner*—Phuong K Dinh
(74) *Attorney, Agent, or Firm*—Jerry D. Haynes; Law Office of Jerry D. Haynes.

(57) ABSTRACT

A control apparatus for controlling a plurality of electrical devices is provided. The control apparatus includes a first body member, a second body member hingedly attached to the first body member, a power outlet strip, a power key lock, and an electronic timer. The control apparatus is capable of assuming one of a plurality of positions between an open position and a closed position. The power outlet strip includes a plurality of electrical receptacles and each of the plurality of electrical receptacles is capable of receiving an electric socket of an electrical device of the plurality of electrical devices. The power key lock and the electronic timer are disposed on the first body member. The electronic timer is capable of activating the power key lock for controlling power supply to the plurality of electrical devices connected to the plurality of electrical receptacles of the power outlet strip.

5 Claims, 4 Drawing Sheets

CONTROL APPARATUS FOR ELECTRICAL DEVICES

FIELD OF THE DISCLOSURE

The present disclosure generally relates to electrical security devices, and, more particularly, to a control apparatus for electrical devices configured to control unauthorized use of the electrical devices.

BACKGROUND OF THE DISCLOSURE

Electrical devices have seen tremendous technological advancement in recent times. The electrical devices find their utility in all spheres of life and as such have become an essential part of a human life. The electrical devices may be grouped depending upon their utility at various places. The electrical devices, which include but not limited to televisions, audio/video players, video game consoles, and electrical kitchen appliances such as microwaves, grinders, food processors and the like, are employed at homes for daily chores and recreational purposes. Moreover, the electrical devices such as photocopiers, typewriters, and the like, find their utility at commercial establishments. However, there are various electrical devices such as computers, printers, air conditioners, and the like, which find their utility both at home and commercial establishments.

Rampant use of the electrical devices has led to irresponsible and unauthorized use thereof. For example, excessive use of electrical devices such as televisions, video game consoles, and the like by children for watching or playing may be a cause of concern for parents. Accordingly, it may become necessary for the parents to restrict excessive usage of such electrical devices by the children. Alternatively, parents may restrict viewing of television by the children for a limited time only and allowing viewing of only that content which they consider as appropriate.

Similarly, in commercial establishments, irresponsible and unauthorized use of the electrical devices by many people intentionally or unintentionally is common. For example, computers may be subject to unauthorized use by people who are not permitted to use the same. Also, electrically powered copying machines are often subjected to extensive unauthorized usage that may cause loss to a commercial establishment.

Many attempts have been made to control the use of the electrical devices, thereby minimizing unauthorized use of the electrical devices both at home and commercial establishments. For example, security devices such as a closed circuit television (CCTV) camera may be installed at a place where the electrical devices have been kept, both at homes and commercial establishments to avoid unauthorized use of the electrical devices. However, such security devices are expensive, have complex structural configurations, and are difficult to install.

Accordingly, there exists a need for an apparatus capable of restricting irresponsible and unauthorized use of electrical devices. Further, there exists a need for an apparatus for controlling electrical devices, which is simple in structural configuration, cost effective and user-friendly.

SUMMARY OF THE DISCLOSURE

In view of the foregoing disadvantages inherent in the prior art, the general purpose of the present disclosure is to provide a control apparatus for electrical devices capable of controlling irresponsible and unauthorized use of the electrical devices, configured to include all the advantages of the prior art, and to overcome the drawbacks inherent therein.

Accordingly, an object of the present disclosure is to provide a control apparatus for electrical devices, which is simple in structural configuration, cost effective and user-friendly.

Another object of the present disclosure is to provide a control apparatus for electrical devices that is capable of controlling irresponsible and unauthorized use of the electrical devices at residential places.

Yet another object of the present disclosure is to provide a control apparatus for electrical devices that is capable of controlling irresponsible and unauthorized use of the electrical devices at commercial establishments.

In light of the above objects, in one aspect of the present disclosure, a control apparatus for controlling a plurality of electrical devices is provided.

The control apparatus includes a first body member, a second body member hingedly attached to the first body member, a power outlet strip, a power key lock, and an electronic timer. The first body member includes a base portion and a plurality of sidewalls extending from the base portion. The base portion and the plurality of sidewalls configure a cavity. The second body member is hingedly attached to the first body member for facilitating the control apparatus to assume one of a plurality of positions between an open position and a closed position. The power outlet strip is disposed on the second body member and is capable of being received in the cavity of the first body member in the closed position of the control apparatus. Further, the power outlet strip is adapted to receive power supply from a power supply source. The power outlet strip includes a plurality of electrical receptacles and each of the plurality of electrical receptacles is capable of receiving an electric socket of an electrical device of the plurality of electrical devices. The power key lock is disposed on the first body member and is capable of controlling the power supply to the plurality of electrical receptacles. Furthermore, the electronic timer is disposed on the first body member and is capable of activating the power key lock for controlling power supply to the plurality of electrical devices connected to the plurality of electrical receptacles of the power outlet strip.

Further, a locking mechanism is provided that is configured to lock the first body member and the second body member in the closed position, thereby preventing an access of the control apparatus to any unauthorized user.

These together with other aspects of the present disclosure, along with the various features of novelty that characterize the present disclosure, are pointed out with particularity in the claims annexed hereto and form a part of this present disclosure. For a better understanding of the present disclosure, its operating advantages, and the specific objects attained by its uses, reference should be made to the accompanying drawings and descriptive matter in which there are illustrated exemplary embodiments of the present disclosure.

BRIEF DESCRIPTION OF THE DRAWINGS

The advantages and features of the present disclosure will become better understood with reference to the following detailed description and claims taken in conjunction with the accompanying drawings, wherein like elements are identified with like symbols, and in which:

Like reference numerals refer to like parts throughout the description of several views of the drawings.

DETAILED DESCRIPTION OF THE DISCLOSURE

The exemplary embodiments described herein detail for illustrative purposes are subject to many variations in structure and design. It should be emphasized, however, that the present disclosure is not limited to a particular control apparatus, as shown and described. It is understood that various omissions and substitutions of equivalents are contemplated as circumstances may suggest or render expedient, but these are intended to cover the application or implementation without departing from the spirit or scope of the claims of the present disclosure. Also, it is to be understood that the phraseology and terminology used herein is for the purpose of description and should not be regarded as limiting.

The terms "first," "second," and the like, herein do not denote any order, quantity, or importance, but rather are used to distinguish one element from another, and the terms "a" and "an" herein do not denote a limitation of quantity, but rather denote the presence of at least one of the referenced item.

The present disclosure provides a control apparatus for electrical devices for restricting irresponsible and unauthorized use of the electrical devices. The control apparatus is capable of being used at homes and commercial establishments. At homes, the control apparatus helps parents to monitor and control children by controlling various electrical devices such as televisions, video game consoles, and the like.

Moreover, at commercial establishments, the control apparatus prevents unauthorized use of electrical devices, such as computers, photocopying machines and the like.

Figure 1:
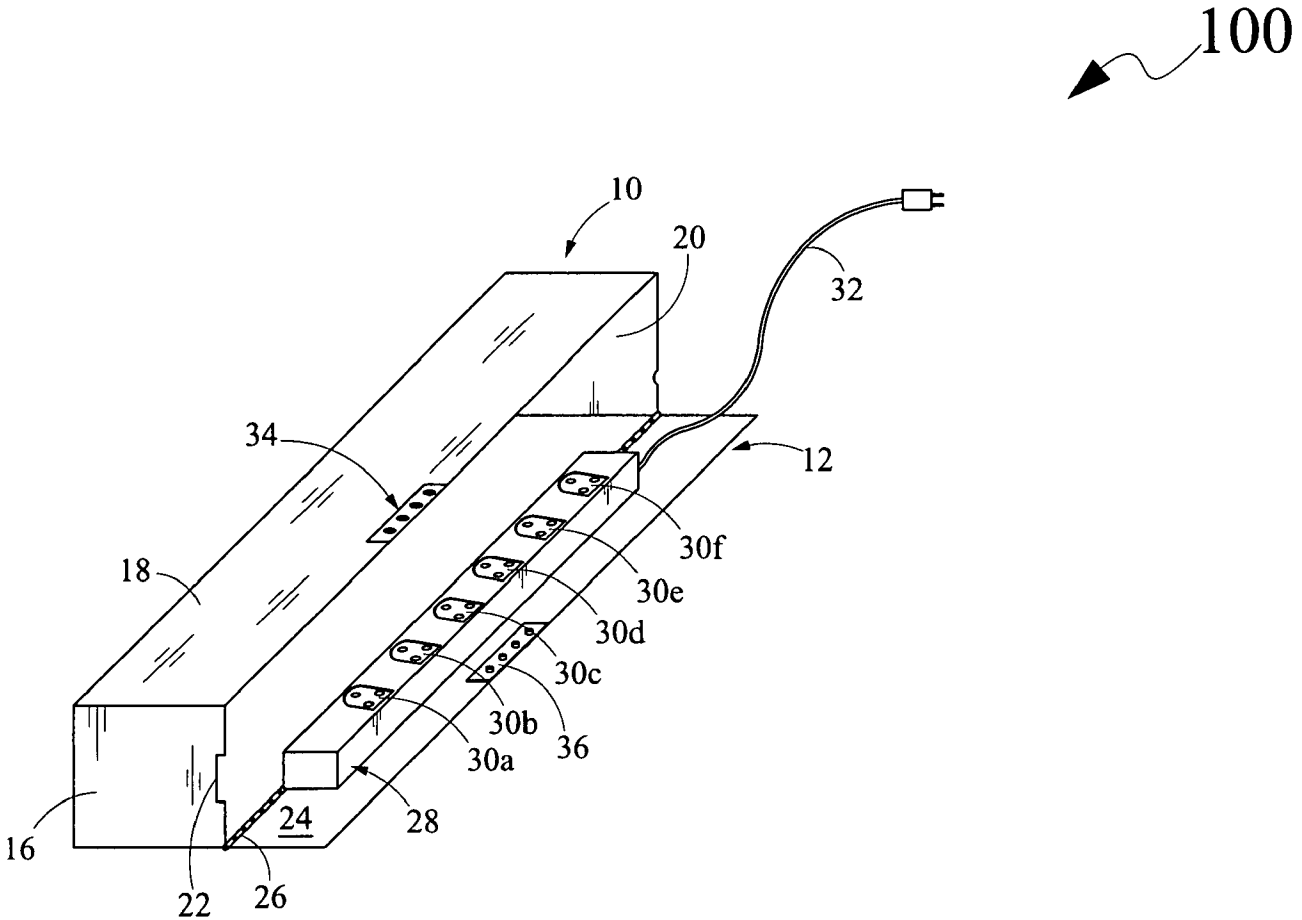
FIG. 1 illustrates a perspective view of a control apparatus for electrical devices in an open position, in accordance with an embodiment of the present disclosure.
Figure 2:
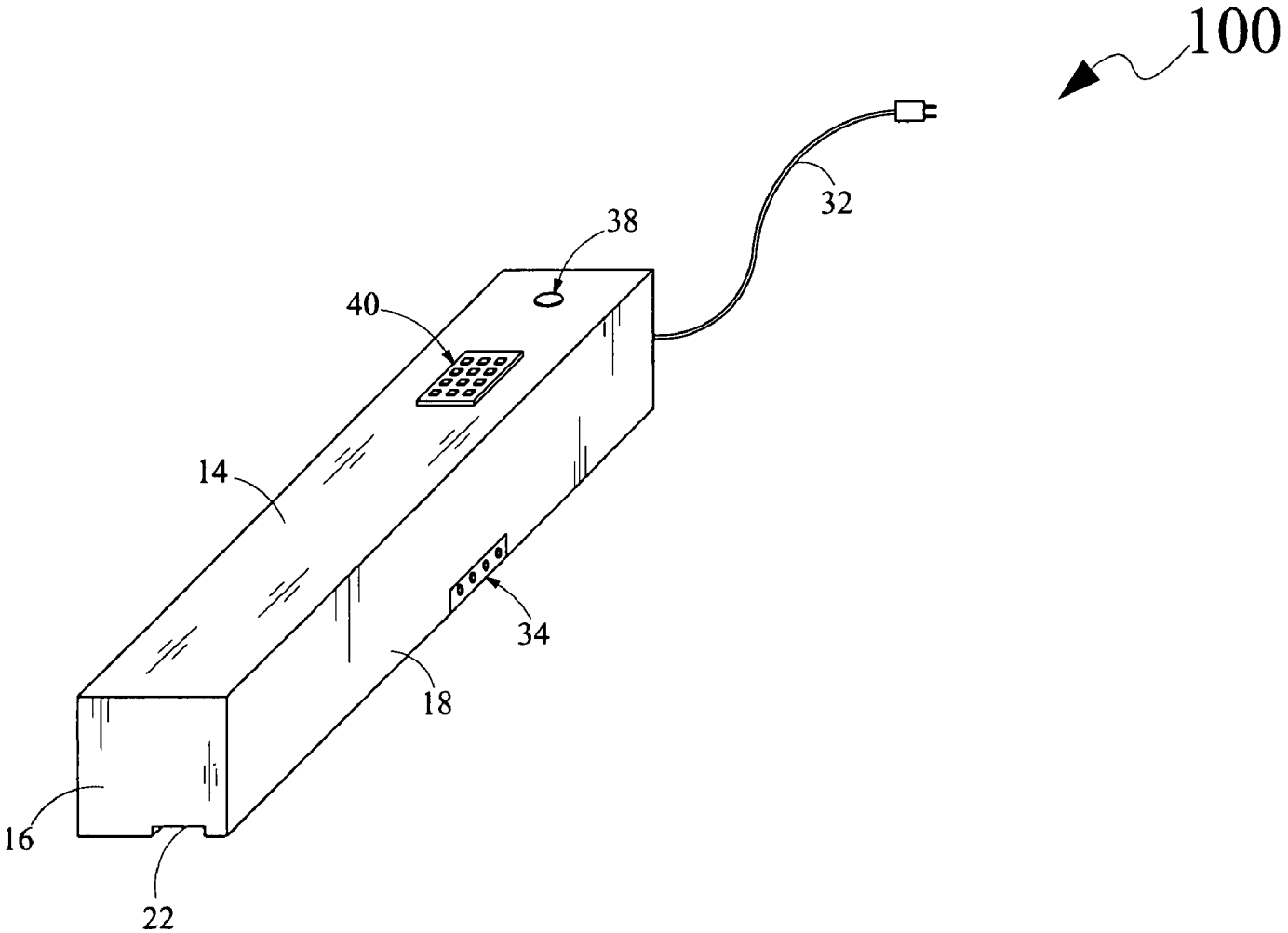
FIG. 2 illustrates a perspective view of the control apparatus of FIG. 1 in a closed position, in accordance with an embodiment of the present disclosure.

With reference to FIGS. 1 and 2, a control apparatus 100 for electrical devices (not shown) is illustrated, in accordance with an embodiment of the present disclosure. The control apparatus 100 includes a first body member 10 and a second body member 12 hingedly attached to the first body member 10. The second body member 12 is hingedly attached to the first body member 10 for facilitating the control apparatus 100 to assume one of a plurality of positions between an open position and a closed position. More specifically, FIG. 1 illustrates the control apparatus 100 in the open position and FIG. 2 illustrates the control apparatus 100 in the closed position.

The first body member 10 of the control apparatus 100 may be of any size and shape known in the art such as rectangular, circular, polygonal, and the like, however for the sake of brevity, the first body member 10 is shown as rectangular in the present embodiment. Specifically, the first body member 10 may assume a rectangular configuration having a base portion 14 (shown in FIG. 2), and a plurality of sidewalls such as a first sidewall 16, a second sidewall (not shown) opposite to the first sidewall 16, a third sidewall 18, and a fourth sidewall (not shown) opposite to the third sidewall 18, each extending from the base portion 14. The base portion 14 and the plurality of sidewalls such as the first sidewall 16, the second sidewall, the third sidewall 18 and the fourth sidewall collectively configure a cavity 20 as shown in FIG. 1. Further, the first sidewall 16 may include a slit such as a slit 22 capable of providing a space between the first body member 10 and the second body member 12 during the closed position of the control apparatus 100. Similarly, the second sidewall includes a slit (not numbered) capable of providing a space between the first body member 10 and the second body member 12 during the closed position of the control apparatus 100. The first body member 10 may be made of a lightweight and sturdy material such as plastic, metal, and the like.

The second body member 12 includes an inner surface 24 and an outer surface (not shown). Further, the second body member 12 is hingedly attached to the first body member 10 by means of a hinge mechanism, such as a hinge mechanism 26. It will be evident to a person skilled in the art that the hinge mechanism 26 may be any conventional hinge mechanism known in the art. The hinge mechanism 26 may facilitate a pivotal movement of the first body member 10 with respect to the second body member 12, thereby enabling the control apparatus 100 to assume one of the plurality of positions between the open position and the closed position. The second body member 12 may be made of a lightweight and sturdy material such as plastic, metal, and the like.

Further, the control apparatus 100 includes a power outlet strip 28 disposed on the second body member 12. The power outlet strip 28 is capable of being received in the cavity 20 of the first body member 10 in the closed position of the control apparatus 100. The power outlet strip 28 includes a plurality of electrical receptacles such as electrical receptacles 30*a*, 30*b*, 30*c*, 30*d*, 30*e*, 30*f*, and the like (hereinafter collectively referred to as electrical receptacles 30) and a power cord 32. Each of the electrical receptacles 30 is capable of receiving an electric socket of an electrical device of the plurality of electrical devices. In an embodiment of the present disclosure, the power outlet strip 28 is a surge protector such that each of the plurality of electrical receptacles may function as an outlet surge protector, capable of receiving an electric socket of the plurality of electrical devices. Further, the power outlet strip 28 is adapted to receive power supply from a power supply source (not shown) via the power cord 32. An example of the power supply source may be a direct electricity supply.

Furthermore, the control apparatus 100 includes a locking mechanism configured to lock the first body member 10 and the second body member 12 in the closed position, thereby preventing an access of the control apparatus 100 to any unauthorized user. The locking mechanism may be a digital cam lock having a cam 34 and a base 36. The cam 34 of the locking mechanism may be disposed on the first body member 10 and the base 36 may be disposed on the second body member 12. The locking mechanism is capable of securing the first body member 10 with the second body member 12, and also releasing the first body member 10 from the second body member 12. It may be evident to a person skilled in the art that the digital cam lock as set forth herein is for purposes of illustration and the locking mechanism may be also include a combination lock, an electronic key lock, and the like.

Also, the control apparatus 100 includes a power key lock 38 capable of controlling the power supply from the power supply source to the plurality of electrical receptacles of the power outlet strip 28. The power key lock 38 is adapted to switch off the power supply to the plurality of electrical devices connected to the power outlet strip 28. In the present embodiment, the power key lock 38 is assumed to be configured on the base portion 14 of the first body member 10, however, it will be evident to a person skilled in the art that the power key lock 38 may be configured on any of the plurality of sidewalls of the first body member 10. Moreover, it will be evident to a person skilled in the art that the power key lock 38 may be electrically coupled to the electrical receptacles 30 of the power outlet strip 28 for controlling the supply of electrical power from the power supply source to the electrical receptacles 30. In an embodiment of the present disclosure, the power key lock 38 may be operable by an electronic timer 40 (as shown in FIG. 2). The electronic timer 40 may be an electronic keypad having various keys disposed thereon for allowing a user to set a time such that the plurality of electrical devices connected to the electrical receptacles 30 may be automatically switched off beyond the time set on the electronic keypad. In another embodiment of the present disclosure, the power key lock 38 may be operable by a magnetic card swipe system (not shown). The magnetic card swipe system may be similar to a magnetic card swipe system known in the art. In yet another embodiment of the present disclosure, the power key lock 38 may be remotely operable by a remote control (not shown).

Figure 3A:
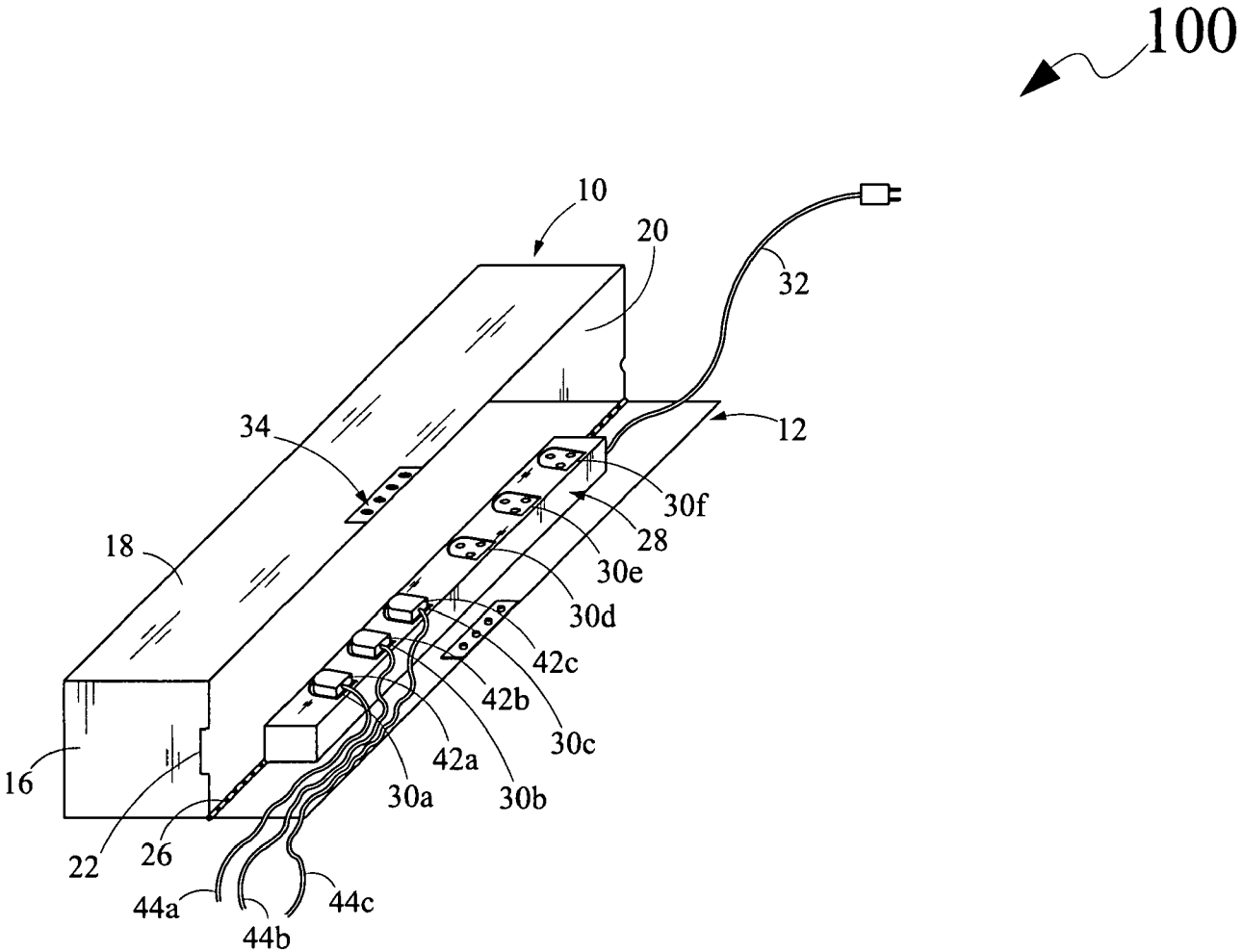
FIG. 3A illustrates a perspective view of the control apparatus of FIGS. 1 and 2 in an open position with a plurality of electric sockets of a plurality of electrical devices connected to the control apparatus, in accordance with an exemplary embodiment of the present disclosure.

Referring to FIG. 3A, the control apparatus 100 is illustrated in an open position, in accordance with an exemplary embodiment of the present disclosure. More specifically, FIG. 3A illustrates a plurality of electric sockets, such as electric sockets 42*a*, 42*b*, and 42*c* of the plurality of electrical devices (not shown) received in the plurality of electrical receptacles, such as the electrical receptacles 30*a*, 30*b*, and 30*c* of the power outlet strip 28. The plurality of electric sockets, such as the electric sockets 42*a*, 42*b*, and 42*c* may be attached to the plurality of electrical devices via plurality of electric cords, such as cords 44*a*, 44*b*, and 44*c*. The plurality of electrical devices may include but not limited to a television, a video game console, a computer, a music system, and the like. The power cord 32 is capable of connecting the electrical receptacles 30 with a power supply source (not shown) to provide the requisite power supply to the electrical receptacles 30.

Figure 3B:
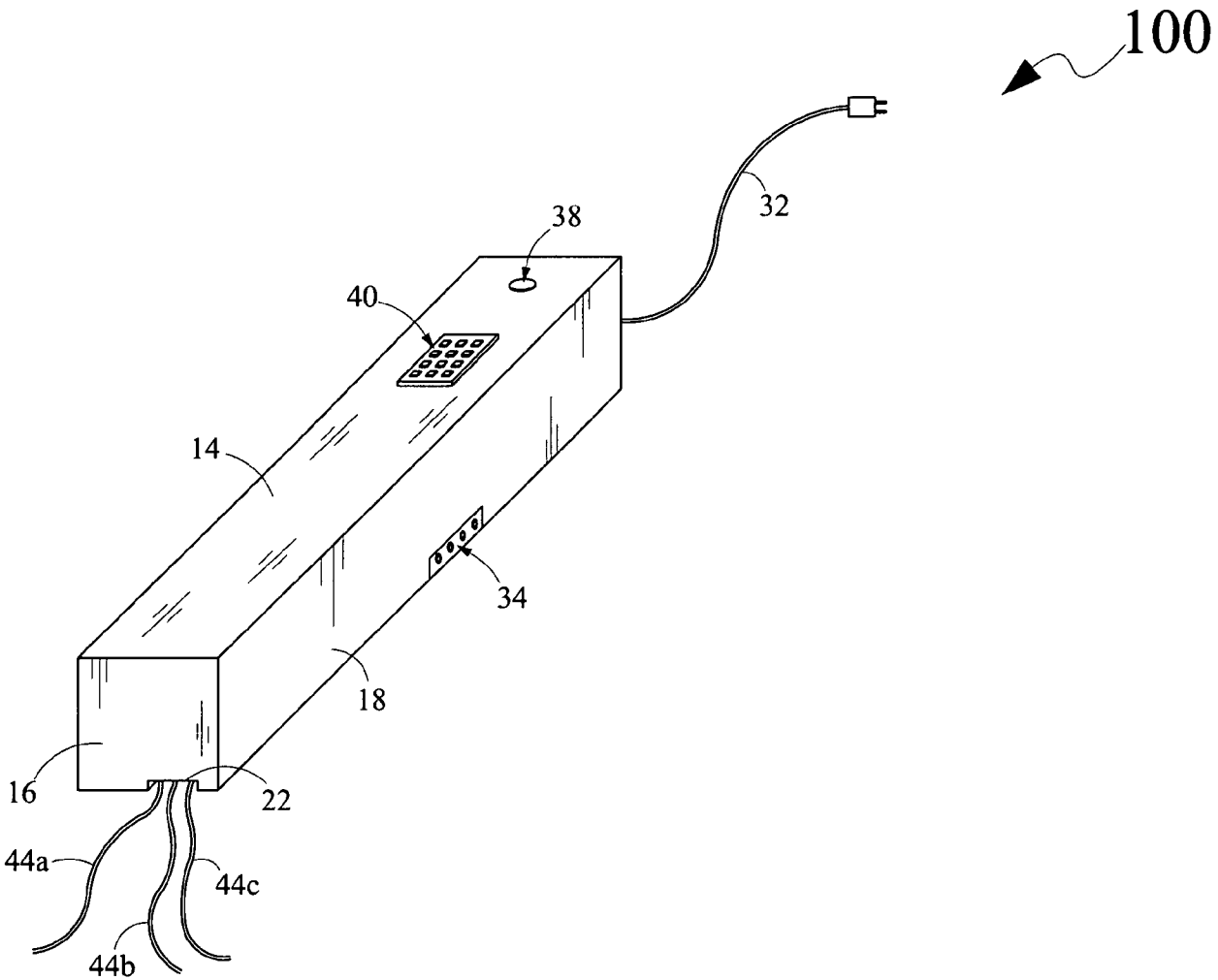
FIG. 3B illustrates a perspective view of the control apparatus of FIG. 3A in a closed position, in accordance with the exemplary embodiment of the present disclosure.

Now referring to FIG. 3B, the control apparatus 100 is illustrated in a closed position, in accordance with the exemplary embodiment of the present disclosure. More specifically, FIG. 3B illustrates the first body member 10 being received on the second body member 12 in a manner such that the power outlet strip 28 is enclosed within the cavity 20 of the first body member 10.

In use, the control apparatus 100 is capable of assuming one of the plurality of positions between the open position and the closed position. More specifically, the second body member 12 hingedly secured to the first body member 10, is capable of being released from the first body member 10 by operating the locking mechanism such that the control apparatus 100 assumes the open position. Once the control apparatus 100 has assumed the open position, a plurality of electric sockets such as the electric sockets 42*a*, 42*b*, and 42*c* of the plurality of electrical devices (not shown) may be received in the plurality of electrical receptacles such as the electrical receptacles 30*a*, 30*b*, and 30*c* of the power outlet strip 28. The first body member 10 may again be received on the second body member 12, thereby facilitating the control apparatus 100 to assume the closed position. Thereafter, the locking mechanism may be operated to secure the first body member 10 with the second body member 12. Once, the first body member 10 has been locked with the second body member 12, the power cord 32 may be connected to the power supply source for providing requisite power supply to the electrical receptacles 30 of the power outlet strip 28, which in turn may provide the power supply to the plurality of electrical devices connected to the power outlet strip 28.

However, supply of the power supply to the plurality of electrical devices is controlled by the power key lock 38. Further, the electronic timer 40 is provided, which is capable of setting duration of time for which the plurality of electrical devices may be used. The electronic timer 40 may be an electronic keypad having various keys disposed thereon for allowing a user to set a time such that the plurality of electrical devices connected to the electrical receptacles 30 may be automatically switched off beyond the time set on the electronic keypad.

The control apparatus 100 may be configured in a multitude of sizes and shapes. In an embodiment of the present disclosure, the control apparatus 100 may be about 15 inches in length, about 3½ inches in width and about 3½ inches in height.

The disclosed control apparatus such as the control apparatus 100 for electrical devices is advantageous for controlling irresponsible and unauthorized use of the electrical devices. The control apparatus may be employed at homes or commercial establishments. At homes the control apparatus may help parents to monitor and control their children by controlling various electrical devices such as televisions, video game consoles, and the like. Similarly, in commercial establishments, the control apparatus may help to prevent irresponsible and unauthorized use of the electrical devices such as computers, photocopying machines, and the like, by people The foregoing descriptions of specific embodiments of the present disclosure have been presented for purposes of illustration and description. They are not intended to be exhaustive or to limit the present disclosure to the precise forms disclosed, and obviously many modifications and variations are possible in light of the above teaching. The embodiments were chosen and described in order to best explain the principles of the present disclosure and its practical application, and thereby enable others skilled in the art to best utilize the present disclosure and various embodiments with various modifications as are suited to the particular use contemplated. It is understood that various omissions and substitutions of equivalents are contemplated as circumstances may suggest or render expedient, but such are intended to cover the application or implementation without departing from the spirit or scope of the claims of the present disclosure.

What is claimed is:

1. A control apparatus for controlling a plurality of electrical devices, the control apparatus comprising:

a first body member having a base portion and a plurality of sidewalls extending from the base portion, the base portion and the plurality of sidewalls configuring a cavity;

a second body member hingedly attached to the first body member for facilitating the control apparatus to assume one of a plurality of positions between an open position and a closed position;

a power outlet strip disposed on the second body member and capable of being received in the cavity of the first body member in the closed position of the control apparatus, the power outlet strip adapted to receive power supply from a power supply source, the power outlet strip comprising a plurality of electrical receptacles, each of the plurality of electrical receptacles capable of receiving an electric socket of an electrical device of the plurality of electrical devices;

a power key lock disposed on the first body member, the power key lock capable of controlling the power supply to the plurality of electrical receptacles;

an electronic timer disposed on the first body member, the electronic timer capable of activating the power key lock for controlling power supply to the plurality of electrical devices connected to the plurality of electrical receptacles of the power outlet strip; and an electronic keypad included on the electronic timer, the electronic keypad capable of turning off the plurality of electrical device connected to the electrical receptacles beyond a time set by the electronic keypad.

2. The control apparatus of claim 1 further comprising a locking mechanism configured to lock the first body member and the second body member in the closed position.

3. The control apparatus of claim 1, wherein the power outlet strip comprises a power cord capable of connecting the plurality of electrical receptacles to the power supply source for providing the power supply to the plurality of electrical receptacles.

4. The control apparatus of claim 1, wherein the power key lock is operable by a magnetic card swipe system.

5. The control apparatus of claim 1, wherein the power key lock is remotely operable by a remote control.

* * * * *